US006945877B2

(12) United States Patent
Kobayashi et al.

(10) Patent No.: US 6,945,877 B2
(45) Date of Patent: Sep. 20, 2005

(54) GOLF CLUB

(75) Inventors: Katsuhiro Kobayashi, Tsubame (JP); Kuniji Kobe, Tokyo-to (JP)

(73) Assignees: K.K.ENDO Seisakusho, Tsubame (JP); Seiko S-Yard Co., LTD, Tokyo (JP)

( * ) Notice: Subject to any disclaimer, the term of this patent is extended or adjusted under 35 U.S.C. 154(b) by 1 day.

(21) Appl. No.: 10/781,633

(22) Filed: Feb. 20, 2004

(65) Prior Publication Data

US 2004/0166960 A1 Aug. 26, 2004

(30) Foreign Application Priority Data

Feb. 24, 2003 (JP) ..... 2003-046632

(51) Int. Cl.[7] ..... A63B 53/04
(52) U.S. Cl. ..... 473/345; 473/349
(58) Field of Search ..... 473/324–350, 473/290–291, 256

(56) References Cited

U.S. PATENT DOCUMENTS 3,084,940 A * 4/1963 Cissel ..... 473/332
3,863,932 A * 2/1975 Lezatte ..... 473/342
5,076,585 A * 12/1991 Bouquet ..... 473/343
5,447,309 A * 9/1995 Vincent ..... 473/345
5,570,886 A * 11/1996 Rigal et al. ..... 473/345
5,755,624 A * 5/1998 Helmstetter ..... 473/291
6,254,494 B1 * 7/2001 Hasebe et al. ..... 473/349
6,315,678 B1 * 11/2001 Teramoto ..... 473/291

FOREIGN PATENT DOCUMENTS

JP 11-333037 12/1999

* cited by examiner

*Primary Examiner*—Sebastiano Passaniti
(74) *Attorney, Agent, or Firm*—Westerman, Hattori, Daniels & Adrian, LLP

(57) ABSTRACT

A golf club is provided in which, whether the loft angle is small or large, backspin is reduced and there is no decrease in carry. A golf club construction is obtained wherein, in a driver club head (1) comprising a face section 4 having a striking surface, a sole section (3) forming the bottom, a crown section (2) forming the top and a back section (3*a*) forming the back portion, when the loft angle is small, the amount of backspin is reduced and performance is maintained, and even when the loft angle is large, the amount of backspin is reduced and a good carry distance is achieved. For this purpose, the crown section (2) is improved, with the provision of a weight (8) on the inside surface thereof nearer to the face section than the center of the surface

10 Claims, 10 Drawing Sheets

| No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|
| 1 | 42.8 | 57.2 | 134 | 16.4 | 2,810 | 206 | 12 | 218 |
| 2 | 42.7 | 57.0 | 133 | 16.6 | 2,580 | 206 | 13 | 219 |
| 3 | 42.8 | 57.0 | 133 | 16.7 | 2,710 | 206 | 12 | 218 |
| 4 | 42.9 | 57.2 | 133 | 16.8 | 2,840 | 206 | 12 | 218 |
| 5 | 42.7 | 56.9 | 133 | 16.6 | 2,660 | 205 | 13 | 218 |
| 6 | 42.9 | 57.0 | 133 | 16.7 | 2,390 | 206 | 14 | 220 |
| 7 | 42.9 | 57.1 | 133 | 16.5 | 2,810 | 206 | 12 | 218 |
| 8 | 42.6 | 56.8 | 133 | 16.7 | 2,950 | 205 | 11 | 216 |
| 9 | 42.9 | 57.0 | 133 | 16.6 | 2,480 | 206 | 13 | 219 |
| 10 | 42.7 | 56.8 | 133 | 17.5 | 2,510 | 206 | 12 | 218 |
| 11 | | | | | | | | |
| Ave. | 42.8 | 57.0 | 133 | 16.7 | 2,674.0 | 205.8 | 12.4 | 218.2 |

| No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|
| 1 | 42.6 | 57.2 | 134 | 16.6 | 2,500 | 206 | 14 | 220 |
| 2 | 42.9 | 57.3 | 134 | 16.5 | 2,680 | 207 | 12 | 219 |
| 3 | 42.5 | 57.2 | 135 | 16.6 | 2,510 | 207 | 13 | 220 |
| 4 | 42.8 | 57.3 | 134 | 16.4 | 2,830 | 207 | 12 | 219 |
| 5 | 42.9 | 57.1 | 133 | 16.7 | 3,020 | 206 | 11 | 217 |
| 6 | 42.9 | 57.3 | 134 | 16.3 | 2,790 | 206 | 12 | 218 |
| 7 | 42.7 | 57.1 | 134 | 13.8 | 2,470 | 206 | 14 | 220 |
| 8 | 42.9 | 57.3 | 134 | 13.7 | 2,780 | 207 | 12 | 219 |
| 9 | 42.7 | 57.3 | 134 | 16.9 | 3,000 | 207 | 11 | 218 |
| 10 | 42.6 | 57.2 | 134 | 16.5 | 2,560 | 207 | 13 | 220 |
| 11 | | | | | | | | |
| Ave. | 42.8 | 57.2 | 134 | 16.6 | 2,714.0 | 206.6 | 12.4 | 219 |

FIG.9

| | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Loft 11° | | | | | | | | | |
| 19mm from face 10g | 1 | 43.1 | 58.1 | 135 | 11.7 | 2,300 | 196 | 26 | 222 |
| | 2 | 43.0 | 58.1 | 135 | 11.5 | 2,160 | 194 | 28 | 222 |
| | 3 | 42.9 | 58.1 | 135 | 11.6 | 2,120 | 195 | 28 | 223 |
| | 4 | 43.2 | 58.0 | 134 | 11.6 | 2,370 | 195 | 25 | 220 |
| | 5 | 42.7 | 58.0 | 136 | 11.6 | 2,100 | 193 | 28 | 221 |
| | 6 | 42.7 | 58.3 | 137 | 12.0 | 1,060 | 197 | 27 | 224 |
| | 7 | 42.9 | 58.3 | 136 | 11.9 | 2,280 | 198 | 25 | 223 |
| | 8 | 43.3 | 58.0 | 134 | 11.6 | 2,460 | 196 | 24 | 220 |
| | 9 | 43.0 | 58.0 | 135 | 11.7 | 2,220 | 196 | 26 | 222 |
| | 10 | 43.1 | 58.1 | 135 | 11.7 | 2,320 | 196 | 25 | 221 |
| | 11 | | | | | | | | |
| | 12 | | | | | | | | |
| Back 10g | Ave. | 43.0 | 58.1 | 135 | 11.7 | 2,239.0 | 195.6 | 26.2 | 221.8 |

FIG.10

| | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Loft 11° | | | | | | | | | |
| 19mm from face 10g | 1 | 43.0 | 57.6 | 134 | 12.0 | 2,270 | 194 | 25 | 219 |
| | 2 | 43.0 | 57.6 | 134 | 11.9 | 2,190 | 193 | 27 | 220 |
| | 3 | 42.9 | 57.5 | 134 | 12.0 | 2,370 | 195 | 24 | 219 |
| | 4 | 43.1 | 57.7 | 134 | 11.8 | 2,410 | 195 | 24 | 219 |
| | 5 | 43.2 | 57.6 | 133 | 12.1 | 2,290 | 194 | 25 | 219 |
| | 6 | 43.3 | 57.5 | 133 | 11.8 | 2,720 | 192 | 21 | 213 |
| | 7 | 43.1 | 57.4 | 133 | 12.1 | 2,410 | 194 | 24 | 218 |
| | 8 | 43.2 | 57.5 | 133 | 12.1 | 2,340 | 195 | 25 | 220 |
| | 9 | 43.2 | 57.6 | 133 | 12.1 | 2,740 | 198 | 21 | 219 |
| | 10 | 43.2 | 57.6 | 133 | 12.4 | 2,490 | 197 | 23 | 220 |
| | 11 | | | | | | | | |
| Middle of sole 10g | 12 | | | | | | | | |
| | Ave. | 43.1 | 57.6 | 133 | 12.0 | 2,423.0 | 194.7 | 23.9 | 218.6 |

| No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|
| 1 | 42.5 | 58.2 | 137 | 10.3 | 3,080 | 196 | 22 | 218 |
| 2 | 42.4 | 58.3 | 138 | 10.8 | 3,250 | 199 | 19 | 218 |
| 3 | 42.3 | 58.3 | 138 | 10.2 | 3,410 | 198 | 19 | 217 |
| 4 | 42.5 | 58.4 | 137 | 10.6 | 3,020 | 199 | 21 | 220 |
| 5 | 42.6 | 58.5 | 137 | 10.5 | 3,120 | 198 | 21 | 219 |
| 6 | 42.5 | 58.6 | 138 | 10.3 | 3,120 | 198 | 21 | 219 |
| 7 | 42.5 | 58.1 | 137 | 10.6 | 3,440 | 198 | 18 | 216 |
| 8 | | | | | | | | |
| 9 | | | | | | | | |
| 10 | | | | | | | | |
| 11 | | | | | | | | |
| 12 | | | | | | | | |
| Ave. | 42.5 | 58.3 | 137 | 10.5 | 3,205.7 | 198 | 20.1 | 218.1 |

| | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Loft 15.5° | | | | | | | | | |
| | 1 | 42.7 | 56.4 | 132 | 18.7 | 3,180 | 204 | 9 | 213 |
| | 2 | 42.6 | 56.5 | 133 | 18.2 | 3,090 | 204 | 10 | 214 |
| | 3 | 42.7 | 56.3 | 132 | 18.5 | 3,030 | 204 | 9 | 213 |
| | 4 | 42.7 | 56.5 | 132 | 18.5 | 3,160 | 205 | 8 | 213 |
| | 5 | 42.9 | 56.6 | 132 | 18.1 | 2,900 | 206 | 10 | 216 |
| | 6 | | | | | | | | |
| | 7 | | | | | | | | |
| | 8 | | | | | | | | |
| | 9 | | | | | | | | |
| | 10 | | | | | | | | |
| | 11 | | | | | | | | |
| | 12 | | | | | | | | |
| | Ave. | 42.7 | 56.5 | 132 | 18.4 | 3,072.0 | 204.6 | 9.2 | 213.8 |

| | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Loft 15.5° | | | | | | | | | |
| | 1 | 42.8 | 56.7 | 132 | 15.8 | 3,130 | 202 | 12 | 214 |
| | 2 | 43.0 | 56.7 | 132 | 16.1 | 3,250 | 202 | 11 | 213 |
| | 3 | 43.0 | 56.8 | 132 | 16.0 | 3,020 | 203 | 12 | 215 |
| | 4 | 43.0 | 56.7 | 132 | 16.1 | 3,120 | 202 | 12 | 214 |
| | 5 | 43.0 | 56.7 | 132 | 16.2 | 3,160 | 203 | 11 | 214 |
| | 6 | | | | | | | | |
| | 7 | | | | | | | | |
| | 8 | | | | | | | | |
| | 9 | | | | | | | | |
| | 10 | | | | | | | | |
| | 11 | | | | | | | | |
| | 12 | | | | | | | | |
| | Ave. | 43.0 | 56.7 | 132 | 16.0 | 3,136.0 | 202.4 | 11.6 | 214 |

Crown Weight 25g in a position 5mm from the leading part

| No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|
| 1 | 42.9 | 57.4 | 134 | 12.4 | 2,430 | 197 | 23 | 220 |
| 2 | 42.8 | 57.4 | 134 | 12.4 | 2,680 | 198 | 21 | 219 |
| 3 | 42.9 | 58.0 | 135 | 11.3 | 2,540 | 196 | 24 | 220 |
| 4 | 42.9 | 58.0 | 135 | 12.1 | 2,350 | 198 | 24 | 222 |
| 5 | 43.2 | 57.4 | 133 | 11.1 | 2,870 | 193 | 22 | 215 |
| Ave. | 42.9 | 57.6 | 134 | 11.9 | 2,574 | 196 | 23 | 219 |

Crown Weight 25g in a position 19mm from the leading part

| No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|
| 1 | 43.0 | 58.0 | 135 | 12.1 | 2,210 | 197 | 26 | 223 |
| 2 | 42.7 | 58.0 | 136 | 12.2 | 2,240 | 197 | 25 | 222 |
| 3 | 43.0 | 58.7 | 137 | 12.3 | 2,290 | 202 | 23 | 225 |
| 4 | 43.1 | 58.1 | 135 | 12.7 | 2,060 | 199 | 25 | 224 |
| 5 | 42.9 | 58.1 | 135 | 12.2 | 2,030 | 195 | 27 | 222 |
| Ave. | 42.9 | 58.2 | 135 | 12.3 | 2,166 | 198 | 25 | 223 |

Crown Weight 25g in a position 33mm from the leading part

| No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|
| 1 | 43.1 | 58.8 | 136 | 12.2 | 2,970 | 205 | 18 | 223 |
| 2 | 43.2 | 58.4 | 135 | 11.8 | 2,870 | 202 | 19 | 221 |
| 3 | 43.2 | 58.6 | 136 | 11.8 | 2,670 | 201 | 22 | 223 |
| 4 | 43.1 | 58.3 | 135 | 12.1 | 2,860 | 202 | 19 | 221 |
| 5 | 43.4 | 58.5 | 135 | 10.8 | 3,550 | 198 | 16 | 214 |
| Ave. | 43.2 | 58.5 | 135 | 11.7 | 2,984 | 202 | 19 | 220 |

FIG.17

| | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Crown Weight 15g in a position 19mm from the leading part 10g at the sole | 1 | 43.3 | 58.9 | 136 | 12.9 | 1,930 | 201 | 25 | 226 |
| | 2 | 43.0 | 58.9 | 137 | 12.6 | 2,280 | 202 | 22 | 224 |
| | 3 | 42.9 | 58.9 | 137 | 12.2 | 1,980 | 199 | 26 | 225 |
| | 4 | 43.3 | 59.1 | 136 | 12.2 | 1,950 | 198 | 27 | 225 |
| | 5 | 43.3 | 58.7 | 136 | 12.4 | 1,950 | 199 | 27 | 226 |
| | Ave. | 43.2 | 58.9 | 136 | 12.5 | 2,018 | 200 | 25 | 225 |

FIG.18

| | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Crown Weight 10g in a position 19mm from the leading part 10g at the sole 5g at the back | 1 | 43.2 | 59.0 | 137 | 12.2 | 2,670 | 205 | 20 | 225 |
| | 2 | 43.3 | 59.3 | 137 | 12.0 | 2,570 | 206 | 21 | 227 |
| | 3 | 43.4 | 58.7 | 135 | 12.1 | 2,590 | 203 | 21 | 224 |
| | 4 | 43.4 | 58.5 | 135 | 13.1 | 2,270 | 203 | 22 | 225 |
| | 5 | 43.0 | 58.8 | 137 | 13.6 | 2,140 | 206 | 21 | 227 |
| | Ave. | 43.3 | 58.9 | 136 | 12.6 | 2,448 | 205 | 21 | 226 |

FIG.19

| | No. | Head Sp. (m/s) | Ball Sp. (m/s) | Meeting rate (%) | Lauching angel (degree) | Backspin (r.p.m) | Carry (yard) | Run (yard) | Total (yard) |
|---|---|---|---|---|---|---|---|---|---|
| Crown Weight 10g in a position 19mm from the leading part 5g at the sole 10g at the back | 1 | 42.7 | 58.8 | 138 | 12.7 | 2,510 | 205 | 21 | 226 |
| | 2 | 42.9 | 58.7 | 137 | 12.8 | 2,410 | 203 | 21 | 224 |
| | 3 | 43.0 | 58.4 | 136 | 12.8 | 2,690 | 204 | 19 | 223 |
| | 4 | 42.9 | 58.6 | 137 | 13.0 | 2,400 | 205 | 20 | 225 |
| | 5 | 42.8 | 58.5 | 137 | 13.2 | 2,650 | 206 | 18 | 224 |
| | Ave. | 42.9 | 58.6 | 137 | 12.9 | 2,532 | 205 | 20 | 224 |

GOLF CLUB

BACKGROUND OF THE INVENTION

1. Field of the Invention

The present invention relates to a golf club. In more detail, it relates to a golf club which is improved by arranging a weight, chiefly in the crown section, in order to improve carry.

2. Description of the Related Art

Usually, when teeing off, a golf club called a "driver" is employed in order to achieve a long carry. The carry directly influences the score, so conditions at the impact point on the head of the golf club represent a vital factor. Although the face section i.e. the striking surface is the most important factor, the loft angle is also a factor which cannot be neglected in achieving carry.

In general, if the loft angle is small, the ball flies in a condition closer to the horizontal and a long carry is not usually obtained. On the other hand, if the loft angle is large, the ball flies upwards and in this case also a long carry is not obtained. As described above, the optimum loft angle is set for each club on the basis of experience, though it is also affected by the coefficient of restitution at the position of impact on the face section. Typically, the loft angle is about 11°. The angle of launching of the trajectory of the ball that is struck increases as the loft angle is made larger and, even in this condition, ideally, the golf club should be such as to easily hit the ball in a manner that decreases the amount of backspin.

In order to achieve this, golf clubs are known of a construction facilitating flexing by making the crown section of another material, but they are liable to the formation of cracks. Thus there are various problems concerning golf clubs and various studies have been made. For example, Laid-open Japanese Patent Application No. 11-333037 proposes a golf club in which a weight is disposed at the crown section and the face section, but this does not guarantee an optimum relationship of the speed of backspin rotation and carry. The factors that give a golf ball a long carry are basically three: namely, increasing the initial speed of the ball, the correct amount of backspin, and the correct launching angle. Of these, the coefficient of restitution (C. O. R.) of the face section may be raised in order to increase the initial speed of the ball, but a limit on the coefficient of restitution is imposed by the rules.

On the other hand, the amount of backspin and the launching angle are mutually opposing factors. Ideally, the launching angle is fairly large and the amount of backspin is small, so for example backspin of about 2000 to 3000 rpm is suitable. Even more preferably, the amount of backspin should be as close as possible to 2000 rpm. However, although, in order to obtain a large launching angle, the loft angle suitably tends to be large, as described above, this increases the amount of backspin, giving rise to the problem that the ball rises and hence does not travel far.

As described above, expedients have been adopted in order to increase the carry under various conditions, but the problems have not necessarily been satisfactorily solved. Whereas there are restrictions on increasing the coefficient of restitution in order to achieve a good golf strike, and although, conventionally, the loft angle was increased in order to increase the launching angle, the ideal would be to employ a golf club capable of achieving a long carry by reducing the amount of backspin.

Development of a golf club is therefore desired which, without differing greatly from the conventional shape and without restricting function, should be close to the ideal condition described above, enabling the carry to be extended in a stable fashion.

SUMMARY OF THE INVENTION

The present invention was made in view of the prior art described above to achieve the following objects.

An object of the present invention is to provide a golf club wherein impact performance is maintained even if the launching angle is small and in which the amount of backspin is small even if the launching angle is large, by providing a weight in the crown section.

A further object of the present invention is to provide a golf club which is of the same basic shape as conventionally yet wherein impact performance is improved compared with conventionally, by the provision of a weight, towards the inside surface of the crown section, that is offset towards the face section.

Yet a further object of the present invention is to provide a golf club capable of manufacture at low cost.

The present invention adopts the following means in order to achieve the above objects.

According to a first aspect of the present invention, in a golf club comprising: a face section having a striking surface for striking a golf ball arranged at the front face with respect to the striking direction of a hollow metal golf club head; a sole section forming the bottom of said hollow metal golf club head; a crown section forming the top of said hollow metal golf club head; a back section forming the back portion with respect to the striking direction of said hollow metal golf club head; a toe section forming the front of said hollow metal golf club head; and a heel section forming the rear of said hollow metal golf club head, a weight is arranged so as to have a center of gravity near to the face section than a centerline (B) of the width (A) from said face section to the back surface of said crown section, when said golf club is arranged in an address position and projected in the vertical direction.

According to a second aspect of the present invention, in a golf club according to the first aspect of the present invention, said weight is arranged in said crown section.

According to a third aspect of the present invention, in a golf club according to the first or second aspect of the present invention, said weight is arranged in a plurality on the inside surface of said crown section.

According to a fourth aspect of the present invention, in a golf club according to the first or second aspect of the present invention, the loft angle of said hollow metal golf club head is an angle within the limited range of allowed values of the coefficient of restitution and is an angle of 11±2°.

According to a fifth aspect of the present invention, in a golf club according to the first or second aspect of the present invention, the loft angle of said hollow metal golf club head is an angle outside the limited range of allowed values of the coefficient of restitution, and is an angle of more than 15°.

According to a sixth aspect of the present invention, in a golf club according to the first or second aspect of the present invention, said weight is a weight member that is fixed by welding or spray coating on the inside surface of said crown section.

According to a seventh aspect of the present invention, in a golf club according to the first or second aspect of the present invention, said weight includes a weight arranged in one or more locations selected from said sole section, said back section, said toe section and said heel section, other than the weight in said crown section.

According to an eighth aspect of the present invention, in a golf club according to the first or second aspect of the present invention, when said width is 70 to 127 mm, said weight is a weight of 5 to 25 g whose center of gravity is arranged in a position separated by 5 to 60 mm from said face section towards said back surface.

According to a ninth aspect of the present invention, in a golf club according to the seventh aspect of the present invention, said weight comprises weights that are arranged in three locations, namely, said crown section, said sole section and said back section.

According to a tenth aspect of the present invention, in a golf club according to the seventh aspect of the present invention, said weight comprises weights that are arranged in three locations, namely, said crown section, said toe section and said heel section.

According to an eleventh aspect of the present invention, in a golf club according to the ninth aspect of the present invention, when said width is 70 to 127 mm, said weight is a weight of 5 to 25 g whose center of gravity is arranged in a position separated by 5 to 60 mm from said face section towards said back surface.

According to a twelfth aspect of the present invention, in a golf club according to the tenth aspect of the present invention, when said width is 70 to 127 mm, said weight is a weight of 5 to 25 g whose center of gravity is arranged in a position separated by 5 to 60 mm from said face section towards said back surface.

As described in detail above, a golf club according to the present invention is a golf club whereby the amount of backspin can be decreased not only when the loft angle is small but also when the loft angle is large, thanks to the provision of a weight towards the back surface of the crown section, and as a result can achieve a long carry even when the trajectory is low. Also, while the external appearance is the same as conventionally, in comparison with a conventional golf club the cost aspect involves solely addition of a weight. Thus, considering the benefit obtained, low cost is achieved.

BRIEF DESCRIPTION OF THE DRAWINGS

FIG. 9 is a view showing the effect of the head in terms of backspin according to an embodiment and is a view showing data in the case where the loft angle is 11°;

FIG. 10 is a view of data showing another embodiment in the case of FIG. 9;

FIG. 17 is a view showing data in the case where the loft angle is 11° and a weight is provided in the crown section in a position 19 mm from the leading position, in the case where the weight is 15 g in the case of the crown section and 10 g in the case of the sole section;

FIG. 18 is a view showing data in the case where the loft angle is 11° and a weight is provided in the crown section in a position 19 mm from the leading position, in the case where the weight is 10 g in the case of the crown section, 10 g in the case of the sole section and 5 g in the case of the back section; and FIG. 19 is a view showing data in the case where the loft angle is 11° and a weight is provided in the crown section in a position 19 mm from the leading position, in the case where the weight is 10 g in the case of the crown section, 5 g in the case of the sole section and 10 g in the case of the back section.

DESCRIPTION OF THE PREFERRED EMBODIMENTS

Figure 1:
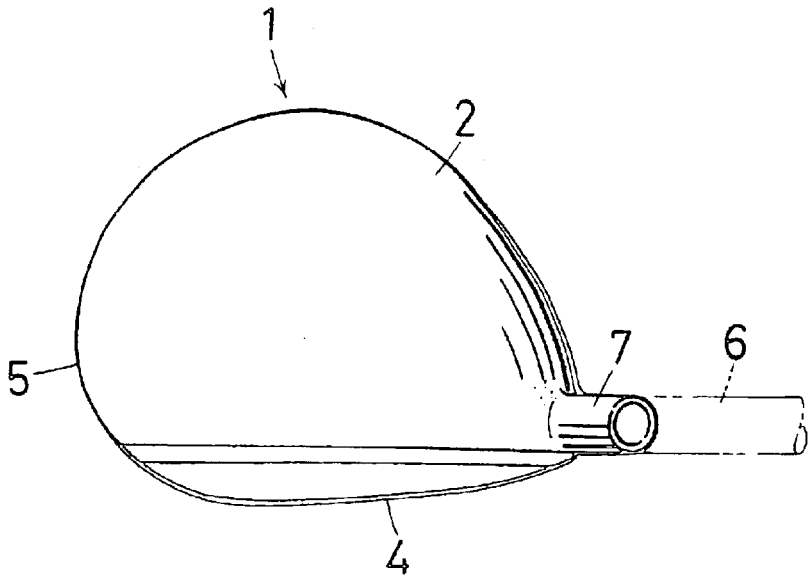
FIG. 1 is a plan view of a driver club head according to the present invention.
Figure 2:
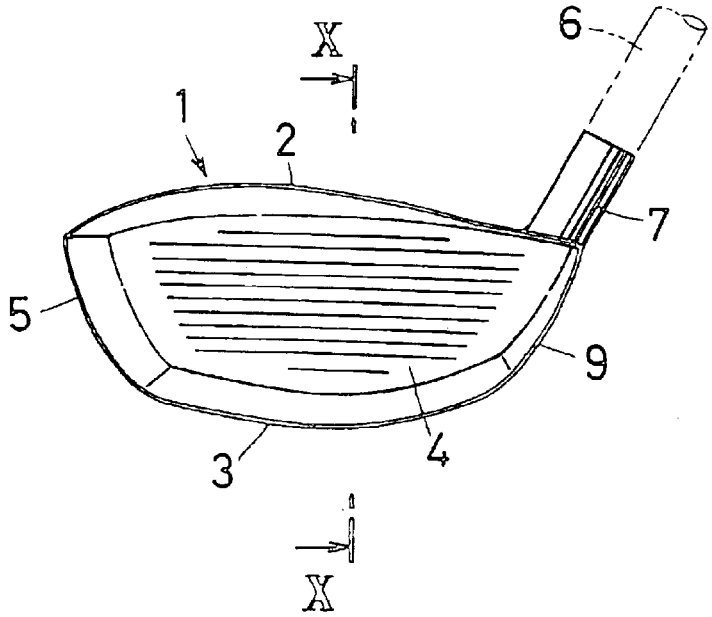
FIG. 2 is a front view of a driver club head according to the present invention.

FIG. 1 and FIG. 2 are external views of a golf club according to the present invention, FIG. 1 being a plan view and FIG. 2 being a front view. The subject of the golf club of the present invention is a hollow metal golf club head. In the actual condition of use, the golf club head is arranged to be supported on a shaft, not shown. In the embodiment, the description will be restricted solely to the head.

Figure 3:
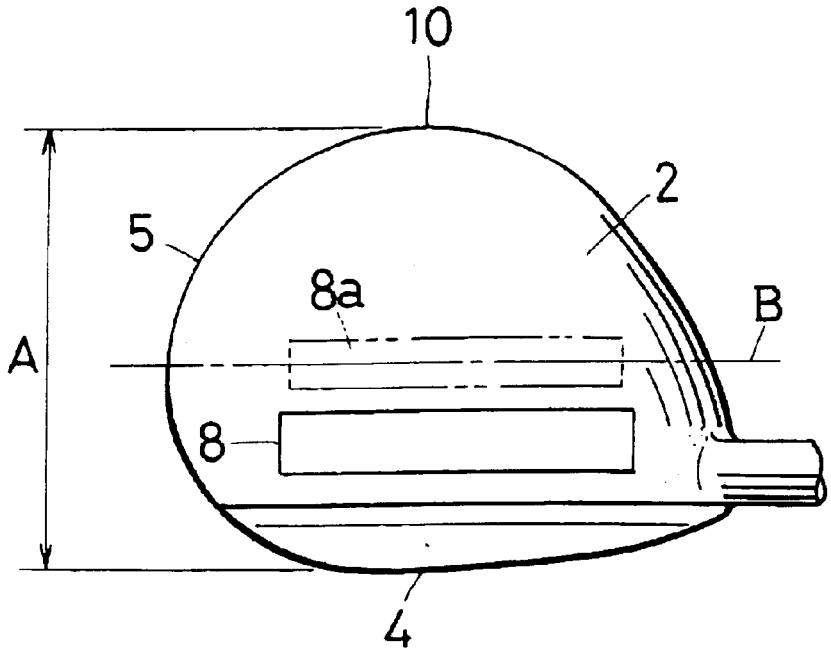
FIG. 3 is a diagram showing the construction of a driver club head according to the present invention.

FIG. 1 to FIG. 6 show an embodiment of a driver club head 1 (hereinbelow also referred to as a head 1) in a metal golf club according to the present invention. FIG. 3 shows the construction of a weight constituting a chief feature of the present invention. The construction of the driver club head 1 will now be described. This head 1 chiefly comprises a crown section 2 corresponding to the top, a sole section 3 corresponding to the bottom, a face section 4 that hits the golf ball, a toe section 5 corresponding to the front of the head 1, a hosel 7 constituting a member for supporting this driver club head 1 on the shaft 6, a back section 3*a* corresponding to the back portion which respect to the striking direction of the head 1, between the crown section 2 and the sole section 3, and a heel section 9 facing the toe section 5 and corresponding to the rear of the head 1.

The drive club head 1 of this embodiment is a golf club head made of metal with a hollow interior. That is, it is a golf club of the so-called wood type of drivers or fairway woods. The head 1 is of an integral construction; in production, it may be constituted by an individual or a plurality of members which are integrated for example by welding after press forming of the individual members. It comprises five components, namely, the face section 4, sole section 3, crown section 2, hosel 7 and weight.

The back section 3*a* is the portion between the crown section 2 and sole section 3 and corresponds to the rear of the driver club head 1, being arranged opposite the face section 4. Such a head 1 is obtained by blanking sheet material to the prescribed shape and press forming while heating. After pressing, flash is removed and TIG welding performed. In this embodiment, the material employed is titanium alloy. Regarding the components, the face section 4 and sole section 3 are butted together and then joined with the hosel 7 and the members associated with the pressed crown section 2 are coupled by TIG welding. In this way, an integral driver club head 1 is constituted.

This embodiment is described below in further detail. FIG. 1 and FIG. 2 are views showing the external appearance of the driver club head 1, being external views showing the condition in which the head is placed in the address position with a lie angle of 60°. The external shape of this driver club head 1 is substantially the same as conventionally. A characteristic feature of this embodiment comprises improvements to the crown section 2. FIG. 3 is a diagrammatic view and is a plan view like FIG. 1.

In this embodiment, the size of this driver club head 1 is indicated by the dimension A from the face section 4 to the back surface 10 of the crown section 2 (or back section 3*a*). Specifically, the dimension A is the width (see FIG. 3) of the club head when projected in a vertical (perpendicular) direction with respect to the crown section 2. The centerline B is arranged approximately in the halfway position of this dimension. The length from the heel section 9 to the toe section 5 and the length from the sole section 3 to the top of the crown section 2, like the dimension A, are in a range specified by the design of the club in accordance with the rules of golf.

In this embodiment of the present invention, a weight 8 is provided further towards the face section 4 than this centerline B, in other words, between the face section 4 and the centerline B. As will be described, in the case where a plurality of weights are provided, the center of gravity of the weights as a whole is provided further towards the face section 4 than the centerline B. As this weight 8, a weight member made for example of metal is welded or spray coated at the interior back surface of the crown section 2. It would be possible to provide the weight 8 on the outside surface of the crown section 2, but the external appearance would be adversely affected, so it is preferable to provide the weight at the interior back surface of the crown section.

This weight 8 may be positioned in any position at the wall surface at the interior back surface of the crown section 2, but, as mentioned above, may be provided further towards the face section 4 than the centerline B. Specifically, if the dimension A is 70 to 127 mm, the position of this weight 8 is preferably at an intermediate position separated by about 5 to 60 mm from the face section 4 towards the centerline B i.e. from the face section 4 towards the back surface 10. The weight of the weight 8 is 5 to 25 g.

Also, the weights 8 that are provided at the internal back surface of the crown section 2, apart from a weight directly provided on the inside wall surface of the crown section 2, may include a weight provided at a single or a plurality of locations in the sole section 3 or back section 3*a*, or in the toe section 5 or heel section 9. Furthermore, when this plurality of weights is provided divided between two or more locations, for example if the weights are provided in the sole section 3 and/or back section 3*a*, or are provided in the toe section 5 and/or heel section 9, these weights may be arranged so that the center of gravity of this plurality of weights 8 is arranged further towards the face section 4 than the centerline B, even if some of the weights are further towards the back section 3*a* than the centerline B.

In manufacture of this driver club head 1, the head 1 is finally completed by welding the crown section 2, the weight 8 being provided at the back surface of the crown section 2 prior to this step. There is no restriction on the shape of this weight 8 but, as described above, the weight 8 may be provided in a position such that the position of the center of gravity is shifted further towards the face section 4 than conventionally.

In this embodiment, as shown in FIG. 3, a plate-shaped weight 8 is provided further towards the face section 4 than the centerline B. Regarding this position, for example in this embodiment, a 10 g weight 8 is provided in a position 19 mm from the face section 4. Since the width of the dimension A referred to above is from about 90 mm to 92 mm, the actual position of the center of gravity of the weight is a dimension somewhat exceeding 19 mm. Consequently, the position of the center of gravity of the weight 8 in this case is at an intermediate position between the centerline B and the face section 4.

It is also possible to provide a further weight 8*a* in the vicinity of the centerline B, in addition to this weight 8. Furthermore, although it is possible to provide some of the weights 8 in divided fashion towards the back section 3*a* within the crown section 2, even if the weights 8 are arranged in this way, the position of the center of gravity of the weights as a whole may be further towards the face section 4 than the centerline B. This applies in the same way even in the case where the weights are provided in the sole section 3 or back section 3*a*, or in the toe section 5 or heel section 9 in addition to the crown section 2.

Figure 4:
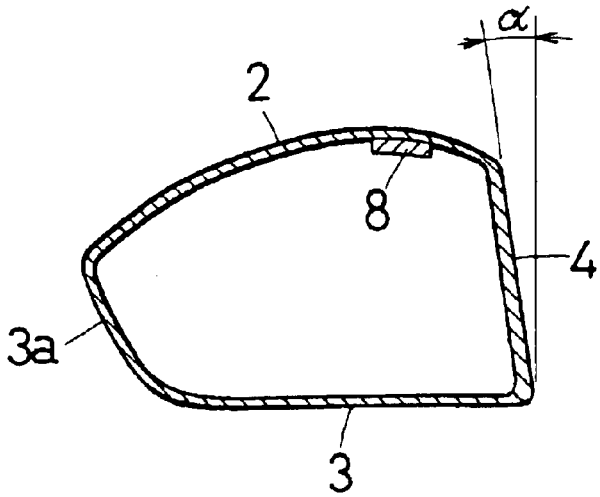
FIG. 4 is a cross-sectional view along the line X—X of FIG. 2 showing an example in which a weight is provided solely in the crown section.

Strictly, a plurality of weights may be arranged such that the center of gravity is further towards the face section than the centerline (B) when projected in the vertical direction, with the golf club arranged in the address position with a lie angle of 60°. FIG. 4 is a view showing a cross section along the line X—X of FIG. 2. Regarding the loft angle, which is a chief feature according to the present invention, if the loft angle $\alpha$ is large, the ball flies upwards and if the loft angle $\alpha$ is small, the ball flies towards the horizontal direction.

The weight 8, constituted by a weight member as shown in FIG. 4, is fixed by welding or spray coating of metal at the back surface of the crown section 2, as described above. In this example of FIG. 4, a weight 8 is provided solely on the internal wall surface of the crown section 2, but, apart from what is shown in the Figure, as this weight 8, there could be provided an additional weight in the vicinity of this weight 8, which is thus divided, or, as described above, additional weights could be provided in the sole section 3, back section 3*a*, toe section 5 or heel section 9.

Figure 5:
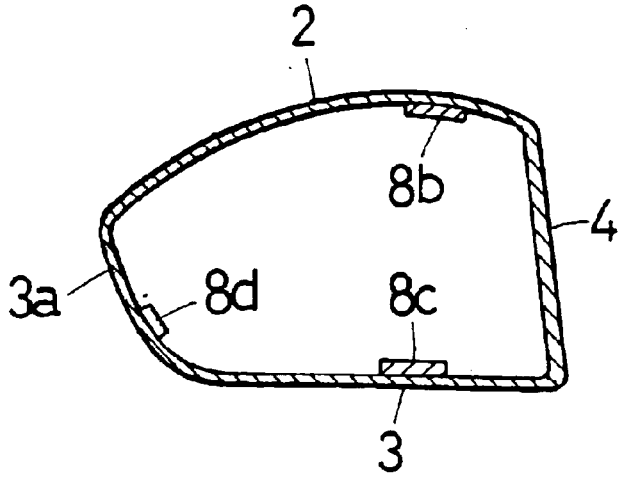
FIG. 5 is a cross-sectional view along the line X—X of FIG. 2 showing an example in which weights are provided in the crown section, sole section and back section.

It has been stated that the object of the present invention can be achieved by the provision of weights in other locations in addition to the crown section 2; specific examples thereof will now be described. In addition to the weight in the crown section 2, weights may be provided in at least one or more locations of arrangement in the sole section 3, back section 3*a*, toe section 5 or heel section 9;

examples in which three weights are provided in different locations will be described. FIG. 5 shows an example of the provision of a crown section weight 8*b* in the crown section 2, a sole section weight 8*c* in the sole section 3 and a back weight 8*d* in the back section 3*a*. In this example, weights are provided in three locations, including the crown section weight 8*b*; although the positions of the weights are different, their center of gravity is positioned further towards the face section 4 than the centerline B, as described above.

Figure 6:
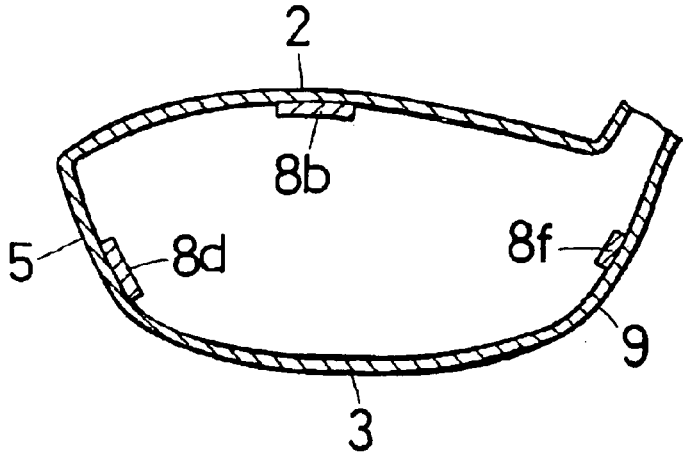
FIG. 6 is a cross-sectional view in the same direction as in FIG. 2 showing an example of the provision of weights in the crown section, toe section and heel section.

FIG. 6 shows an example in which a crown section weight 8*b* is arranged in the crown section 2, a toe section weight 8*e* in the toe section 5 and a heel section weight 8*f* in the heel section 9, respectively. In this example also, weights are provided in three locations but the position of the center of gravity is the same as in the case of the embodiment shown in FIG. 5 and the same effect is obtained. Both examples are examples of a construction in which weights in other locations are added to the weight 8*b* in the crown section 2. There is no restriction regarding the shape or method of mounting.

In these embodiments, it was found by a test of hitting that, irrespective of the magnitude of the loft angle, the amount of backspin was decreased and longer carry was obtained. Specifically, the properties of a golf club whose loft angle is less than 15° and which is subject to restrictions regarding the C.O.R. relating to for example the allowed value of the coefficient of restitution, showing a spring effect, and the properties of a golf club of a loft angle of 15° or more are likewise improved.

From the results obtained with the above embodiment, while it is preferable that the loft angle should be about 11°, specifically, 11±2°, even with a loft angle as large as 15° or more, good results are obtained. In this way, a golf club may be realized whereby a suitable amount of backspin is obtained and a good strike can be achieved by increasing the loft angle, compared with conventionally. This is because, for most golfers, it is psychologically more satisfying to be able to view the face section during address, making it easier to strike the ball. The results of hitting are described below with reference to practical examples (test examples), using tables of the data obtained.

PRACTICAL EXAMPLES

Figure 7:
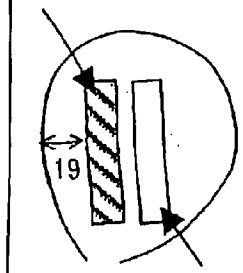
FIG. 7 is a view showing the effect of the head in terms of backspin according to an embodiment and is a view showing data in the case where the loft angle is 15.5°.

Embodiments of improved performance with a construction according to the present invention as described above are described below with reference to data. FIG. 7 to FIG. 19 show test results of applying the present invention to a golf club shown in an embodiment. FIG. 7 is a case where the loft angle is 15.5°. As shown in this Figure, a 10 g weight is provided at a position of dimension 19 mm from the face section 4 (26 mm with respect to the central position of the weight) and, in addition, a 10 g weight 8*c* is provided at the sole section 3, in the vicinity of this weight and further towards the center. The dimension A, referred to above, of this golf club is likewise 90.5 mm. The average value of the amount of backspin obtained as a result of performing 10 hits was 2,674.0 rpm.

Figure 8:
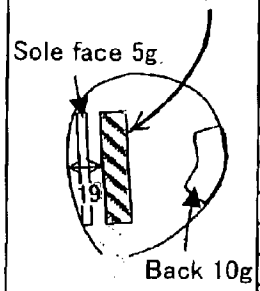
FIG. 8 is a view of data showing another embodiment in the case of FIG. 7.

FIG. 8 is a view showing another example with the same conditions as in FIG. 7. As shown in this Figure, in this example, a 10 g weight 8*b* is provided at a position of dimension 19 mm from the face section 4 and, in addition, a 5 g weight 8*c* is provided at the sole section 3, further towards the vicinity of this weight and, in addition, a 10 g weight 8*d* is provided at the back section 3*a*. The average value of the amount of backspin obtained as a result of performing 10 hits was 2,714.0 rpm.

FIG. 9 shows the case where the loft angle is 11°. As shown in this Figure, in this example, a 10 g weight 8*b* is provided at a position of dimension 19 mm from the face section 4 and, in addition, a 10 g weight 8*d* is provided at the back section 3*a*. The dimension A, referred to above, of this golf club is 92.1 mm. The average value of the amount of backspin obtained as a result of performing 10 hits was 2,239.0 rpm.

FIG. 10 is a view showing another example with the same conditions as in FIG. 9. As shown in this Figure, in this example, a 10 g weight 8*b* is provided at a position of dimension 19 mm from the face section 4 and, in addition, a 10 g weight 8*c* is provided at the middle of the sole section 3. The average value of the amount of backspin obtained as a result of performing 10 hits was 2,423.0 rpm.

Figure 11:
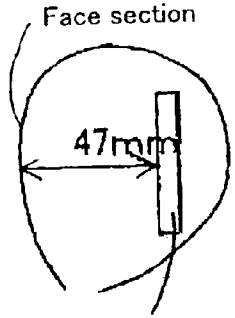
FIG. 11 is a view showing data where the loft angle is 11° and the weight in the crown section is provided in a position 47 mm from the face section.
Figure 12:
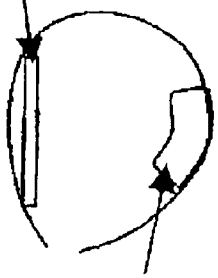
FIG. 12 is a view showing data where the loft angle is 15.5° and no weight is provided in the crown section but weights are provided in the sole section and back section.
Figure 13:
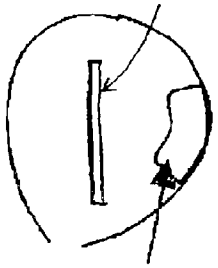
FIG. 13 is a view showing data where, in a case which is otherwise the same as FIG. 12, the weight is altered.

FIG. 11 to FIG. 13 are examples in which weights were provided in positions different from those of the constructions according to the present invention and show the results of tests carried out as comparative examples for comparison with the constructions according to the present invention. FIG. 11 shows an example of a case where the loft angle is 11° and a weight 8*b* is provided in a position 47 mm from the face section 4, only on the inside wall surface of the crown section 2. Specifically, this construction is an example in which the weight was arranged further towards the back section 3*a* than the centerline B. With this example, as a result of tests of conducting hitting seven times, it was found that, while there was no great difference with the case described above regarding the carry, the average value of the amount of backspin showed a large value exceeding 3000 rpm, namely, 3,205.7 rpm.

FIG. 12 and FIG. 13 are examples in which the loft angle is 15.5° and no weight is provided in the crown section 2 but weights are provided in the sole section 3 and the back section 3*a*. FIG. 12 is an example in which a 15 g weight is provided in the sole section 3, towards the face section 4 and a 10 g weight 8*d* is provided in the back section 3*a*. The center of gravity of these two weights is further towards the face section 4 than the centerline B, as described above, but the result of a test in which hitting was conducted five times was that the amount of backspin was 3,072.0 rpm. Also, FIG. 13 is an example in which a 10 g weight was provided in the middle of the sole section 3 and a 10 g weight was provided in the back section 3*a*. The center of gravity of these two weights is further towards the back section than the centerline B. As a result of a hitting test of hitting five times conducted in the same way as in FIG. 12, it was found that the amount of backspin was 3,136.0 rpm. In all cases, the result was that the amount of backspin exceeded 3000 rpm. Furthermore, no advantage was obtained in terms of increased carry.

Figure 14:
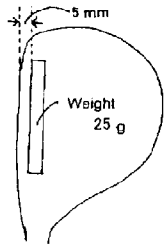
FIG. 14 is a view showing data in the case where the loft angle is 11° and a 25 g weight is provided in the crown section in a position 5 mm from the leading position.
Figure 15:
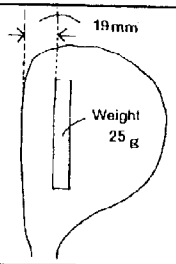
FIG. 15 is a view showing data in the case where the loft angle is 11° and a 25 g weight is provided in the crown section in a position 19 mm from the leading position.
Figure 16:
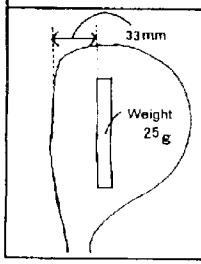
FIG. 16 is a view showing data in the case where the loft angle is 11° and a 25 g weight is provided in the crown section in a position 33 mm from the leading position.

Next, the views shown in FIG. 14 to FIG. 16 show the results of a comparison in the case of provision of a weight 8*b* in the crown section 2, the position of the weight with respect to the face section 4 being different, the amount of the weight being the same. The loft angle is 11°. FIG. 14 shows the case where a 25 g weight is provided in a position 5 mm from the leading part of the face section; FIG. 15 shows a case where a 25 g weight is provided in a position 19 mm from the leading part of the face section; and FIG. 16 shows the case where a 25 g weight is provided in a position 33 mm from the leading part of the face section.

When the results are compared with the results obtained in the case of FIG. 11 to FIG. 13 described above, good results are obtained in all cases, but, in particular, the case of FIG. 15 gave the most beneficial results in that the average value of the amount of backspin in a test in which hitting was conducted five times was 2166 rpm and good carry was obtained. These results show that good results are obtained when the position of the weight is somewhat separated from the face section 4 and the weight is provided in an intermediate region on the face section 4 side of the centerline B.

FIG. 17 to FIG. 19 show the results of a hitting test when a weight 8*b* was provided in the crown section 2, the amount of the weight being varied but the position of the weight with respect to the face section 4 from the leading part of the face section being the same in all cases, namely, 19 mm. FIG. 17 shows the case where a 15 g weight is provided in the crown section 2 and a 10 g weight is provided in the sole section 3; FIG. 18 shows the case where a 10 g weight is provided in the crown section 2, a 10 g weight in the sole section 3 and a 5 g weight in the back section 3*a*; and FIG. 19 shows the case where a 10 g weight is provided in the crown section 2, a 5 g weight in the sole section 3 and a 10 g weight in the back section 3*a*.

In all cases, good results were obtained in that good carry was obtained and the amount of backspin was small. Of the three examples, best results were obtained in the case of FIG. 17, where the amount of backspin was 2018 rpm in the average of a hitting test of hitting five times. These results confirm the results of FIG. 15, described above. Also, the material used for the crown section 2 employed in the tests is Ti15V3Cr—3Sn—3Al, of sheet thickness 1.0 mm.

According to the results of these tests, with a construction according to the present invention, if the loft angle is 11°, good results are obtained in terms of both carry and backspin, confirming the effect of the present invention. Even if a high loft angle of 15.5° is employed, the amount of backspin is small (less than 3000 rpm), demonstrating the effect of the present invention.

What is claimed is:

1. A driver golf club comprising:

a face section having striking surface for striking a golf ball arranged at the front face with respect to the striking direction of a hollow metal golf club head;

a sole section forming the bottom of said hollow metal golf club head;

a crown section forming the top of said hollow metal golf club head;

a back section forming the back portion with respect to the striking direction of said hollow metal golf club head;

a toe section forming the front of said hollow metal golf club head; and a heel section forming the rear of said hollow metal golf club head, wherein a weight is arranged so as to have a center of gravity near to the face section than a centerline (B) of the width (A) from said face section to the back surface of said crown section, when said golf club is arranged in an address position and projected in the vertical direction, wherein said weight is arranged in said crown section, being separated from the face section, wherein the loft angle of said hollow metal golf club head is an angle of 11±2°.

2. The driver golf club according to claim 1, wherein said weight is arranged in a plurality on the inside surface of said crown section.

3. The driver golf club according to claim 1, wherein the loft angle of said hollow metal golf club head is an angle outside the limited range of allowed values of the coefficient of restitution, and is an angle of more than 15°.

4. The driver golf club according to claim 1, wherein said weight is a weight member that is fixed by welding or spray coating on the inside surface of said crown section.

5. The driver golf club according to claim 1, wherein said weight includes a weight arranged in one or more locations selected from said sole section, said back section, said toe section and said heel section, other than the weight in said crown section.

6. The driver golf club according to claim 5, wherein said weight comprises weights that are arranged in three locations, namely, said crown section, said sole section and said back section.

7. The driver golf club according to claim 6, wherein when said width is 70 to 127 mm, said weight is a weight of 5 to 25 g whose center of gravity is arranged in a position separated by 5 to 60 mm from said face section towards said back surface.

8. The driver golf club according to claim 5, wherein said weight comprises weights that are arranged in three locations, namely, said crown section, said toe section and said heel section.

9. The driver golf club according to claim 8, wherein when said width is 70 to 127 mm, said weight is a weight of 5 to 25 g whose center of gravity is arranged in a position separated by 5 to 60 mm from said face section towards said back surface.

10. The driver golf club according to claim 1, wherein, when said width is 70 to 127 mm, said weight is a weight of 5 to 25 g whose center of gravity is arranged in a position separated by 5 to 60 mm from said face section towards said back surface.

* * * * *